United States Patent [19]

Clarke, III et al.

[11] Patent Number: 4,475,734

[45] Date of Patent: Oct. 9, 1984

[54] DUAL WATER CHAMBER BULLET TRAP

[75] Inventors: Oliver L. Clarke, III, Edwardsville; William E. Orrill, Godfrey, both of Ill.

[73] Assignee: Olin Corporation, Stanford, Conn.

[21] Appl. No.: 539,343

[22] Filed: Oct. 5, 1983

[51] Int. Cl.[3] ..... F41J 1/12

[52] U.S. Cl. ..... 273/410

[58] Field of Search ..... 273/410, 404; 73/167

[56] References Cited

U.S. PATENT DOCUMENTS

| | | | |
|---|---|---|---|
| 2,420,304 | 5/1947 | Diem | 273/410 X |
| 3,447,806 | 6/1969 | Pfaff et al. | 273/410 |
| 3,495,829 | 2/1970 | Booth | 273/404 |

FOREIGN PATENT DOCUMENTS

| | | | |
|---|---|---|---|
| 496873 | 4/1930 | Fed. Rep. of Germany | 273/410 |
| 10992 | of 1906 | United Kingdom | 273/410 |

*Primary Examiner*—Paul E. Shapiro

*Attorney, Agent, or Firm*—Bruce E. Burdick

[57] ABSTRACT

A dual chamber bullet trap has a housing divided into two chambers by an impact plate that extends rearwardly and downwardly from the front to the rear of the trap. In one embodiment the impact plate is fixedly sealed to the housing thus defining a lower-forward chamber below the plate partially filled with water for receiving bullets deflected off the plate, and a second water filled chamber above the plate for stopping bullets which penetrate the impact plate when it fails due to repeated bullet impacts. When the impact plate fails water drains from the upper chamber indicating failure of the impact plate. In a second embodiment the impact plate is hinged along its front edge to the top-front of the trap and is free to pivot upwardly upon bullet impact to help dissipate bullet energy. The upper chamber contains a fluid filled container behind the pivoting impact plate. When bullets penetrate the impact plate they pierce the container allowing water to drain therefrom to indicate impact plate failure.

19 Claims, 2 Drawing Figures

DUAL WATER CHAMBER BULLET TRAP

BACKGROUND AND SUMMARY OF THE INVENTION

This invention relates to an improved bullet trap.

Conventional bullet traps are generally of one of four designs: a sand bunker, a convergent impact plate, a water chamber or a flowing water tube. Sand bunker and convergent impact plate traps require a considerable amount of maintenance and do not have any inherent means to indicate a failure (penetration) of the trap other than by visual inspection. Penetration of the trap can result in further projectiles being fired into unintended areas, causing further facility damage and potential risk of injury to personnel if the failure is undetected even for a short period of time. This is particularly true in situations requiring fixed mount weapon firing of relatively large amounts of ammunition. Conventional water chamber traps such as that of U.S. Pat. No. 2,812,660, issued Nov. 12, 1957 to N. D. Marden et al, are not suitable where horizontal firing is needed since such conventional water chamber traps require that the bullet be shot downwardly into the water. Conventional water chamber traps such as that of U.S. Pat. No. 2,420,304, issued May 13, 1947 to D. T. Diem, or U.S. Pat. No. 3,447,806, issued June 3, 1969 to H. Pfaff et al, which have a downwardly rearwardly inclined armored deflection plate above a water chamber do not indicate failures of the impact plate. Sand bunker type bullet traps require daily attention to the raking out of larger projectile masses and to adjust the sand slope. Regular replacement of the sand is required as the sand becomes pulverized through repeated bullet impact and raking. Disposal of the spent sand is difficult and expensive as it must be treated as a hazardous waste due to its lead content. Conventional convergent impact plate traps such as that of U.S. Pat. No. 3,701,532, issued Oct. 31, 1972 to Nikoden et al, require the handling of very heavy armor plate sections to replace worn pieces periodically and do not have any indication of failure of the deflection plate. This work is difficult to accomplish in a confined ballistic range and it requires special equipment for lifting with considerable time and expense. Lead dust generated during use of a convergent impact plate bullet trap requires elaborate ventilation systems with bag house lead dust filtration and recovery or employee respiratory protective equipment. Conventional flowing water tube type bullet traps such as that of U.S. Pat. No. 2,356,992, issued Aug. 29, 1944 to I. R. Gilson, or U.S. Pat No. 3,217,534, issued Nov. 16, 1965 to C. T. Bingham et al, utilize complex piping, pumping equipment, and require power for running pumps, and do not provide failure indication to an operator. There is need for a bullet trap which solves the above problem with existing designs.

It is an object of this invention to provide a bullet trap which gives an indication when a failure occurs.

It is a further object of this invention to provide a bullet trap which requires relatively low maintenance.

It is a further object of this invention to provide a bullet trap which has a relatively low level of lead dust.

The present invention achieves these objects by providing a bullet trap which has an upper water chamber and a lower water chamber separated by an inclined impact plate and an air space. The trap is designed such that the bullet enters the trap and passes through the air space to impact upon the lower surface of the impact plate and fall into the lower water chamber. In the event that the bullet penetrates the impact plate, the bullet would be slowed or stopped by the upper water chamber and the water from the upper water chamber would leak into the lower water chamber to provide an indication of such penetration. The lower water chamber provides for lead dust control and relatively easy separation of the spent bullets of the energy absorbing media, in this case water, and thus eliminates personnel lead dust exposure and sharply reduces the quantity of waste material. The splashing action of the lower water chamber as the lower water chamber receives a bullet cools the impact area of the impact plate to extend plate life, particularly in cases involving automatic gun fire, thus further reducing the maintenance requirements. The trap can be of relatively simple construction and reduced cost compared to any conventional traps. The trap, in a further embodiment, has a flexibly mounted impact plate so that the plate can recoil to absorb bullet energy and thus reduce likelihood of penetration of the plate. Preferably, the plate is rotatably mounted to reduce the angle of bullet incidence upon bullet impact.

BRIEF DESCRIPTION OF THE DRAWINGS

The invention will be better understood by reference to the attached drawings in which:

Referring to FIG. 1, bullet trap 10 comprises a rectangular metal box 11 which is relatively long and narrow and low together with an inlet pipe 38 on the front of the box. Within box 11 are an upper water chamber 12 and a lower water chamber 14 separated by an inclined impact plate 16 and an air space 18. Lower chamber 14 is filled with a liquid 20 to a desired lower liquid level 22. This liquid level 22 is, optionally, indicated through means of a manometer 24 connected through an indicator line 26 to lower water chamber 14. Similarly, a second manometer 32 connected through a second indicator line 34 to upper water chamber 12 indicates the level 30 to which upper chamber 12 is filled with a liquid 28. For economy, lower liquid 20 and upper liquid 28 will normally both be water. Indicator lines 26 and 34 could be directly connected to a water supply for purposes of refilling chambers 12 and 14 or chambers 12 and 14 could be filled by opening the lid 36 of the box 11 and using a garden hose or other simple water supply means. Inlet pipe 38 is a round metal pipe of some suitable diameter such as an inner diameter of 12 inches. Pipe 38 is horizontal and enters air space 18 through an opening 40 in the front side of box 11. Box 40 is provided with two metal shelves 42 which extend along the right and left sides of box 11 from the upper front corners of box 11 to the lower rear corners of box 11 and shelves 42 are rigidly affixed to the sides of box 11 so that they can withstand the forces of repeated impact of bullets upon impact plate 16. Metal rods of L-shaped cross section bolted or welded securely to the inside walls of the sides of box 11 are suitable as shelves 42. Impact plate 16 is preferably at least ½ inch thick rolled homogeneous armor plate or equivalent. Armor plate 16 is removably fastened to metal shelves 42 by suitable restraints such as blocks 54 and adjustable hold down screws 52. Since impact plate 16, and this embodiment, also serves as the floor of chamber 12, a resiliant sealant is placed between shelves 42 and the side edges of impact plate 16 to prevent liquid 28 from leaking out of upper chamber 12 prematurely. For economy, the portion of impact plate 16 which lies below level 22 could be made of weaker material such as ¼ inch cold rolled steel 48, thus leaving only portion 44 of impact plate as being armor plate. For added safety, an additional layer of ½ inch armor plate 46 could be placed on the upper rear surface of floor of box 11 in order to prevent ricochet bullets from penetrating the floor of box 11. Box 11 is elevated slightly by legs 56 so that any leak in the floor of box 11 can be readily detected.

Figure 1:
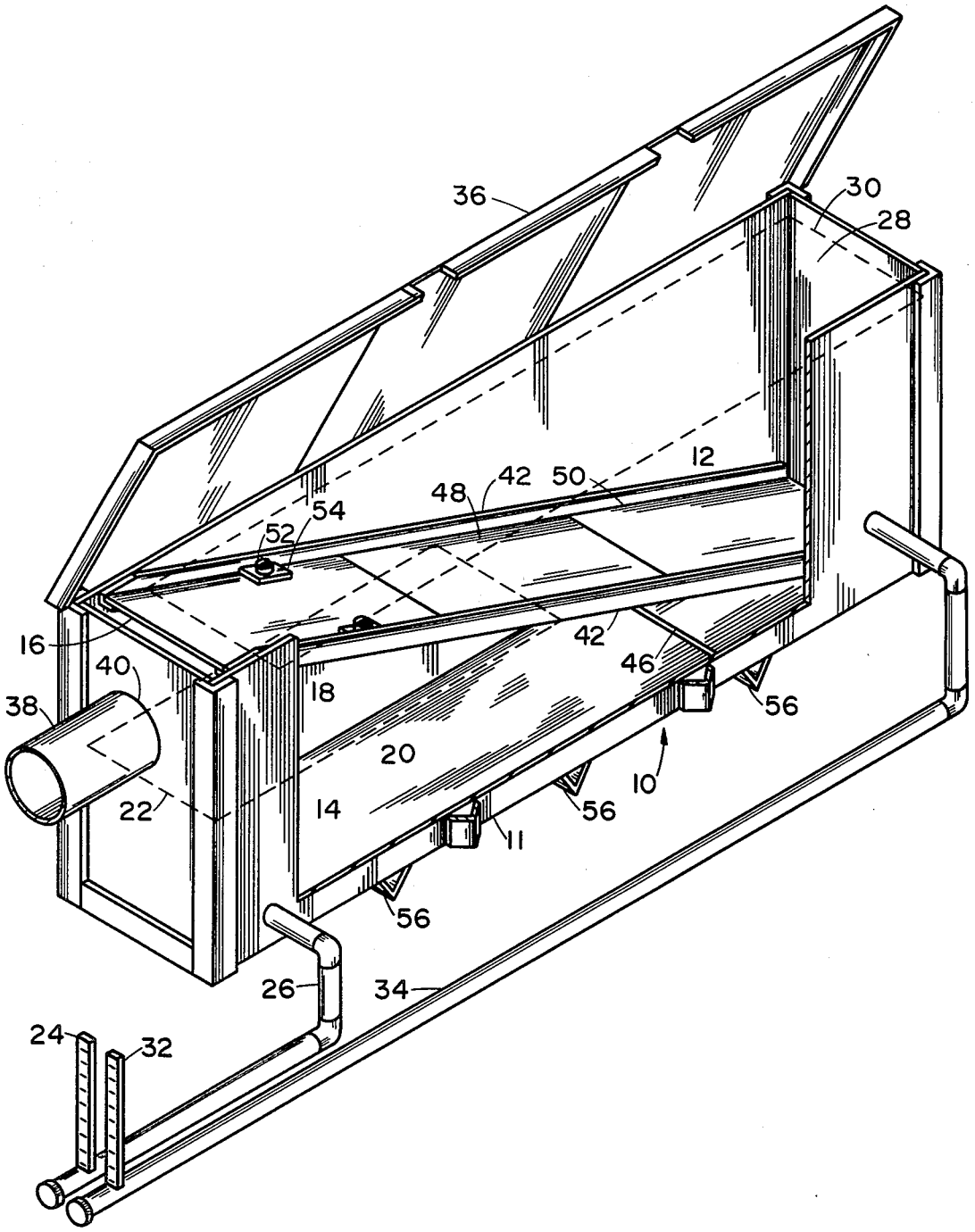
FIG. 1 is an upper right front perspective view of a bullet trap embodying the invention.

In operation, gun fire is directed horizontally through horizontal inlet pipe 38 through the opening 40 in the front of box 11 through wedge-shaped air space 18 against the lower surface of impact plate 16. Upon impact with impact plate 16, bullets are normally deflected downwardly into lower chamber 14 where the bullet energy is absorbed by liquid 20. The splashing action of the deflected bullets as they enter liquid 20 serves to cool the lower surface of impact plate 16 and thus increase the useful life of the impact plate and used in trapping bullets from a rapidly firing automatic weapon. The use of water in the lower chamber also provides for lead dust control and easy separation of the spent projectiles from the energy absorbing media (water), eliminating or greatly reducing the exposure of operating personnel to lead dust and sharply reducing the quantity of waste material. The upper chamber 12 provides for the temporary confinement and absorption of projectiles (bullets) if there is a penetration of the impact plate rather than a deflection as intended. A penetration of the impact plate will cause water in upper chamber 12 to leak into the lower chamber 14 and a change in the upper liquid level 30 or the lower liquid level 22 will indicate failure of the impact plate. This failure will be readily observable to the operator by the change in the reading of manometers 24 and 32 or by flooding of the range itself or by other suitable indicator means such as audible signals or pressure switches or other indicating means. By virtue of this indication, the operator will be able to minimize the number of bullets fired at an impact plate which has already been penetrated by a previous bullet. This is particularly important since, in most production testings, bullets are fired from a bench mount which is held in a fixed position and repetitively fired from that position against a fixed impact point. Once a given bullet penetrates the impact plate, it is relatively likely that succeeding bullets traveling the same flight path will also penetrate the impact plate through the same hole and will do so with increasing velocities as the hole becomes enlarged.

Figure 2:
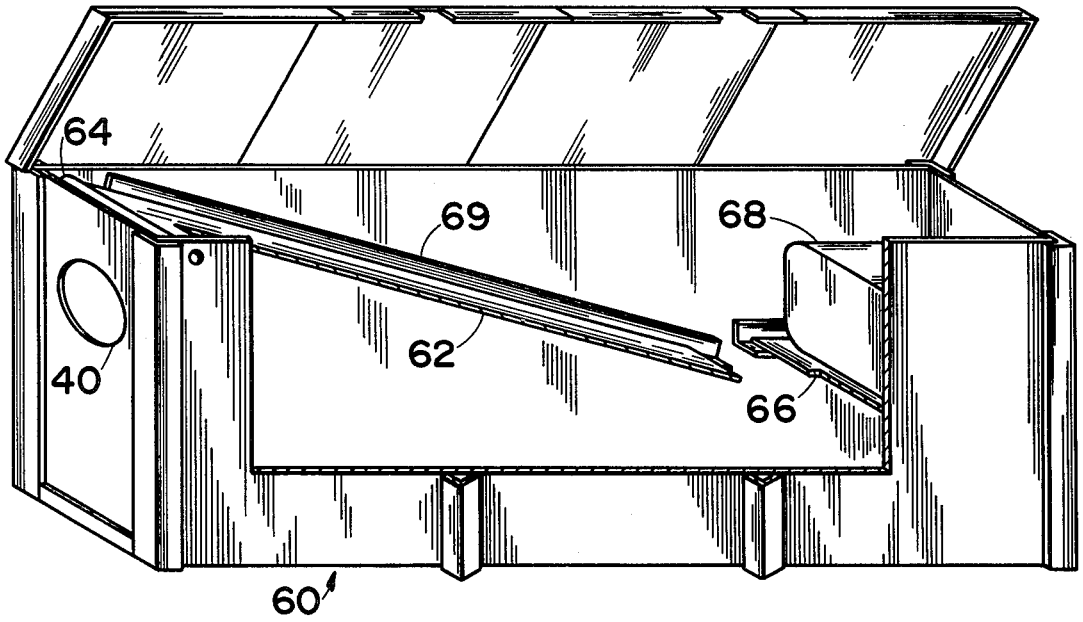
FIG. 2 is an upper right front perspective view of a second bullet trap embodying the invention.

In order to maximize the failure indication and simplify construction, a second embodiment of the invention is visualized as shown in FIG. 2. It will be realized that still further embodiments could be made within the scope of the invention. Referring to FIG. 2, a modified bullet trap 60 is provided with an impact plate 62 which extends rearwardly from the upper front edge of box 11 downwardly at an angle of 15 degrees to a point where it is below the level of the bottom of opening 40 and below the upper surface of liquid 14. The plate 62 rests on an inclined angle iron 69 on an inside left wall of the trap 60. A similar angle iron (not shown due to cutaway in FIG. 2) would be provided on the right inside wall of the trap 60. A hinge 64 is provided along the upper front edge of box 11 and connects the upper front edge of impact plate 62 to the upper front edge of box 11. This allows the impact plate 62 to recoil by pivoting upwardly about hinge 64. This serves a double function. First, the upward rotation reduces the angle of incidence to increase the likelihood of deflection and decrease the likelihood of penetration of the plate. Secondly a substantial part of the bullet energy will be spent in moving the impact plate, so that there is less energy left to cause penetration of the plate. This movable plate feature allows the trap to receive and trap larger caliber rounds than would otherwise be practices. A horizontal shelf 66 is provided at the upper rear of box 11 to support a water bag 68 which serves a similar purpose to that of the upper chamber 12 of FIG. 1. However, when water bag 68 is penetrated by a bullet, substantially all of the water in water bag 68 will rapidly fall into lower chamber 14 thus rapidly indicating to the operator failure of the hinged impact plate 62.

While the figures show the impact plate inclined at an angle of approximately 15 degrees, any incline angle may be used. Incline angles of from about 10 degrees up to about 20 degrees are preferred in order that the likelihood of deflection, rather than penetration, be maximized while still presenting a sufficient incline to give enough height to the impact area to allow for variations in bullet trajectories. Also, incline angles of less than about 10 degrees would result in an unnecessarily long box 11 without any substantial added benefits. Although manometers are suggested as suitable for indicating penetration of the impact plate with resultant leakage of water from the upper chamber to the lower chamber, other failure indication means (e.g., electrical signal plate) could be utilized so long as a positive means for indicating penetration of the impact plate is provided. The impact plate need not be absolutely flat since its main purpose is to deflect bullets downwardly into the lower water chamber. While water is specified in the disclosure and claims, it will be understood that the term water is means to include any other liquid which will later prove useful in such a trap, keeping in mind that the purpose of the liquid is to absorb energy from the deflective bullet and slow it down to the point where there is no danger of it penetrating the box 11.

Many other changes will suggest themselves to those of ordinary skill-in-the-art and the invention is, therefore, to be interpreted as including the broad range of equivalence to which it is entitled.

What is claimed is:

1. A bullet trap which comprises:

a downwardly, rearwardly inclined impact plate for being repetitively impacted by bullets and deflecting said bullets downwardly and rearwardly;

a lower water chamber below said plate for receiving a desired quantity of water and thereafter for receiving and decelerating said deflected bullets; and an indicator means for indicating if said plate is penetrated by one of said bullets, wherein said indicator means comprises an upper water chamber above said impact plate and adopted to receive and decelerate said penetrating bullet.

2. The bullet trap of claim 1 further comprising a sealing means between said upper and lower water chambers for preventing water from said upper water chamber from entering said lower water chamber only until said penetrating bullet penetrates said impact plate and thereafter allowing the water from said upper water chamber to flow into said lower chamber.

3. The bullet trap of claim 2 wherein said sealing means is placed in the expected path of any bullet penetrating the impact plate and is adapted to be ruptured by said penetrating bullet.

4. The bullet trap of claim 2 wherein said sealing means comprises said impact plate itself.

5. The bullet trap of claim 4 wherein said sealing means is a bullet-rupturable layer behind said impact plate along the expected flight path of said penetrating bullet.

6. The bullet trap of claim 5 wherein said layer is a water bag defining said upper water chamber.

7. The trap of claim 1 further comprising a box containing said impact plate, upper water chamber and lower water chamber.

8. The trap of claim 7 wherein said indicator means comprises said upper water chamber, said lower water chamber and a water level indicator outside of said box for indicating changes in the level of water in at least one of said upper and lower water chambers.

9. The bullet trap of claim 7 wherein said metal box is rectangular and impact plate extends diagonally from the upper front inside of said box to the lower rear inside of said box and from and fully across the inside of said box from left inside wall to the right inside wall so as to divide said box diagonally into an upper rear chamber and a lower front chamber.

10. The bullet trap of claim 9 further comprising water sealing means between said impact plate and said box whereby said upper rear chamber can serve as said upper water chamber and said lower front chamber can serve as said lower water chamber.

11. The bullet trap of claim 7 further comprising a horizontal bullet pipe attached to the front of said box with the axis of said pipe passing through the desired impact point on said impact bullet.

12. The bullet trap of claim 1 wherein said impact plate is inclined at angle of no more than 20 degrees relative to the expected path at the expected point of impact of bullets to be trapped.

13. The bullet trap of claim 1 wherein said impact plate is inclined at an angle of no more than 20 degrees relative to horizontal.

14. The bullet trap of claim 1 wherein said impact plate is flexibly mounted so that said impact plate can recoil for increased absorption of energy from impacting bullets.

15. The bullet trap of claim 14 wherein said flexible mounting is a hinge at the front end of said impact plate whereby the inclination of said impact plate is decreased upon bullet impact.

16. The bullet trap of claim 14 wherein said impact plate is angularly movable in response to the impact of a bullet thereupon will thereby provide absorption, by said plate, of a part of the energy of the impacting bullet via the angular acceleration of the impact plate.

17. The bullet trap of claim 16 wherein said level is below the intended impact point on said impact plate whereby bullets travel through air until impact and only after impact enter water.

18. The bullet trap of claim 14 further comprising plate support means for supporting said impact in said inclined position and limiting downward movement of said plate.

19. The bullet trap of claim 1 wherein said lower water chamber is filled to a selected level with water, said level being below the upper end of said impact plate.

* * * * *